US007139007B1

(12) United States Patent
Kawahara

(10) Patent No.: US 7,139,007 B1
(45) Date of Patent: Nov. 21, 2006

(54) GRADATION DISPLAY METHOD CAPABLE OF EFFECTIVELY DECREASING FLICKERS AND GRADATION DISPLAY

(75) Inventor: Isao Kawahara, Osaka (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 247 days.

(21) Appl. No.: 10/110,870

(22) PCT Filed: Oct. 19, 2000

(86) PCT No.: PCT/JP00/07268

§ 371 (c)(1),
(2), (4) Date: Jul. 24, 2002

(87) PCT Pub. No.: WO01/29812

PCT Pub. Date: Apr. 26, 2001

(30) Foreign Application Priority Data

Oct. 19, 1999 (JP) ..... 11-296312

(51) Int. Cl.
*G09G 5/20* (2006.01)

(52) U.S. Cl. ..... 345/690; 345/60

(58) Field of Classification Search ..... 345/692, 345/693, 694, 695, 696, 690, 60
See application file for complete search history.

(56) References Cited

U.S. PATENT DOCUMENTS 5,187,578 A 2/1993 Kohgami et al.
5,739,804 A * 4/1998 Okumura et al. ..... 345/99
5,874,932 A 2/1999 Nagaoka et al.
6,310,588 B1 * 10/2001 Kawahara et al. ..... 345/63
6,714,250 B1 * 3/2004 Correa et al. ..... 348/447

FOREIGN PATENT DOCUMENTS

| | | |
|---|---|---|
| EP | 444962 | 3/1991 |
| EP | 982707 | 8/1998 |
| EP | 0 952 569 A2 | 10/1999 |
| JP | 9-81072 | 3/1997 |
| JP | 10-207426 | 8/1998 |
| JP | 10-319903 | 12/1998 |

* cited by examiner

*Primary Examiner*—Richard Hjerpe
*Assistant Examiner*—Jean Lesperance

(57) ABSTRACT

The present invention provides a gray scale display method and apparatus that can be used with a large screen plasma display panel to perform illumination in a binary manner while substantially controlling flicker effects. The gray scale can be displayed by combining illumination and non-illumination periods in each of a plurality of subfields, the subfields being defined by at least a first block and a second block which have different structures. The plurality of subfields are arranged so that the luminance value of each subfield is in an ascending or descending order in the blocks.

8 Claims, 17 Drawing Sheets

FIG.3

| GRAY LEVEL | LUMINANCE WEIGHT | | | | | | | | | |
|---|---|---|---|---|---|---|---|---|---|---|
| | 4 | 8 | 16 | 32 | 56 | 4 | 12 | 24 | 40 | 56 |
| 0 | | | | | | | | | | |
| 4 | 1 | | | | | | | | | |
| 8 | 1 | | | | | 1 | | | | |
| 12 | | 1 | | | | 1 | | | | |
| 16 | 1 | 1 | | | | 1 | | | | |
| 20 | | 1 | | | | | 1 | | | |
| 24 | | 1 | | | | 1 | 1 | | | |
| 28 | 1 | 1 | | | | 1 | 1 | | | |
| 32 | 1 | | 1 | | | | 1 | | | |
| 36 | 1 | | 1 | | | 1 | 1 | | | |
| 40 | | 1 | 1 | | | 1 | 1 | | | |
| 44 | 1 | 1 | 1 | | | 1 | 1 | | | |
| 48 | 1 | | 1 | | | 1 | | 1 | | |
| 52 | | 1 | 1 | | | 1 | | 1 | | |
| 56 | 1 | 1 | 1 | | | 1 | | 1 | | |
| 60 | | 1 | 1 | | | | 1 | 1 | | |
| 64 | 1 | 1 | 1 | | | | 1 | 1 | | |
| 68 | 1 | 1 | 1 | | | 1 | 1 | 1 | | |
| 72 | 1 | 1 | | 1 | | 1 | | 1 | | |
| 76 | | 1 | | 1 | | | 1 | 1 | | |
| 80 | 1 | 1 | | 1 | | | 1 | 1 | | |
| 84 | | | | 1 | | | 1 | | 1 | |
| 88 | 1 | 1 | | 1 | | 1 | | | 1 | |
| 92 | | 1 | | 1 | | | 1 | | 1 | |
| *1 96 | | 1 | | 1 | | 1 | 1 | | 1 | |
| 100 | 1 | 1 | | 1 | | 1 | 1 | | 1 | |
| 104 | 1 | | 1 | 1 | | | 1 | | 1 | |
| 108 | 1 | | 1 | 1 | | 1 | 1 | | 1 | |
| 112 | 1 | 1 | 1 | 1 | | | 1 | | 1 | |
| 116 | 1 | 1 | 1 | 1 | | 1 | 1 | | 1 | |
| 120 | 1 | | 1 | 1 | | 1 | | 1 | 1 | |
| 124 | | 1 | 1 | 1 | | 1 | | 1 | 1 | |
| 128 | 1 | 1 | 1 | 1 | | 1 | | 1 | 1 | |
| 132 | | 1 | 1 | 1 | | | 1 | 1 | 1 | |
| 136 | 1 | 1 | 1 | 1 | | | 1 | 1 | 1 | |
| 140 | | 1 | 1 | 1 | | 1 | 1 | 1 | 1 | |
| 144 | 1 | | 1 | 1 | | | 1 | 1 | | 1 |
| 148 | 1 | | 1 | 1 | | 1 | 1 | 1 | | 1 |
| 152 | 1 | 1 | 1 | 1 | | | 1 | 1 | | 1 |
| 156 | 1 | 1 | 1 | 1 | | 1 | 1 | 1 | | 1 |
| 160 | 1 | | 1 | 1 | | | 1 | | 1 | 1 |
| 164 | 1 | | 1 | 1 | | 1 | 1 | | 1 | 1 |
| 168 | 1 | 1 | 1 | 1 | | | 1 | | 1 | 1 |
| 172 | 1 | 1 | 1 | 1 | | 1 | 1 | | 1 | 1 |
| 176 | 1 | | 1 | 1 | | 1 | | 1 | 1 | 1 |
| 180 | 1 | 1 | 1 | 1 | | | | 1 | 1 | 1 |
| 184 | 1 | 1 | 1 | 1 | | 1 | | 1 | 1 | 1 |
| 188 | | 1 | 1 | | 1 | | 1 | | 1 | 1 |
| 192 | 1 | 1 | 1 | | 1 | | 1 | | 1 | 1 |
| 196 | 1 | 1 | | 1 | 1 | 1 | 1 | 1 | | 1 |
| 200 | 1 | | 1 | 1 | 1 | | 1 | 1 | | 1 |
| 204 | 1 | | 1 | 1 | 1 | 1 | 1 | 1 | | 1 |
| 208 | | 1 | 1 | 1 | 1 | 1 | 1 | 1 | | 1 |
| 212 | 1 | 1 | 1 | 1 | 1 | 1 | 1 | 1 | | 1 |
| 216 | 1 | | 1 | 1 | 1 | | 1 | | 1 | 1 |
| 220 | | 1 | 1 | 1 | 1 | | 1 | | 1 | 1 |
| 224 | 1 | 1 | 1 | 1 | 1 | | 1 | | 1 | 1 |
| 228 | 1 | 1 | 1 | 1 | 1 | 1 | 1 | | 1 | 1 |
| 232 | 1 | | 1 | 1 | 1 | 1 | | 1 | 1 | 1 |
| 236 | | 1 | 1 | 1 | 1 | 1 | | 1 | 1 | 1 |
| 240 | 1 | 1 | 1 | 1 | 1 | 1 | | 1 | 1 | 1 |
| 244 | 1 | | 1 | 1 | 1 | 1 | 1 | 1 | 1 | 1 |
| 248 | | 1 | 1 | 1 | 1 | 1 | 1 | 1 | 1 | 1 |
| 252 | 1 | 1 | 1 | 1 | 1 | 1 | 1 | 1 | 1 | 1 |
| | SUBFIELD BLOCK 1 | | | | | SUBFIELD BLOCK 2 | | | | |

FIG.7

| GRAY LEVEL | LUMINANCE WEIGHT | | | | | | | | | |
|---|---|---|---|---|---|---|---|---|---|---|
| | 4 | 8 | 16 | 32 | 56 | 4 | 12 | 24 | 40 | 56 |
| 0 | | | | | | | | | | |
| 4 | 1 | | | | | | | | | |
| 8 | 1 | | | | | 1 | | | | |
| 12 | | 1 | | | | 1 | | | | |
| 16 | 1 | 1 | | | | 1 | | | | |
| 20 | | 1 | | | | | 1 | | | |
| 24 | | 1 | | | | 1 | 1 | | | |
| 28 | 1 | 1 | | | | 1 | 1 | | | |
| 32 | 1 | | 1 | | | | 1 | | | |
| 36 | 1 | | 1 | | | 1 | 1 | | | |
| 40 | | 1 | 1 | | | 1 | 1 | | | |
| 44 | 1 | 1 | 1 | | | 1 | 1 | | | |
| 48 | 1 | | 1 | | | 1 | | 1 | | |
| 52 | | 1 | 1 | | | 1 | | 1 | | |
| 56 | 1 | 1 | 1 | | | 1 | | 1 | | |
| 60 | | 1 | 1 | | | | 1 | 1 | | |
| 64 | 1 | 1 | 1 | | | | 1 | 1 | | |
| 68 | 1 | 1 | 1 | | | 1 | 1 | 1 | | |
| 72 | 1 | 1 | 1 | | | 1 | | | 1 | |
| 76 | 1 | | | 1 | | | | | 1 | |
| 80 | 1 | | | 1 | | 1 | | | 1 | |
| 84 | | 1 | | 1 | | 1 | | | 1 | |
| 88 | 1 | | | 1 | | | 1 | | 1 | |
| 92 | | 1 | | 1 | | | 1 | | 1 | |
| *2 96 | 1 | 1 | | 1 | | | 1 | | 1 | |
| 100 | | 1 | | 1 | | 1 | 1 | | 1 | |
| 104 | 1 | | 1 | 1 | | | 1 | | 1 | |
| 108 | 1 | | 1 | 1 | | 1 | 1 | | 1 | |
| 112 | 1 | 1 | 1 | 1 | | | 1 | | 1 | |
| 116 | 1 | 1 | 1 | 1 | | 1 | 1 | | 1 | |
| 120 | 1 | | 1 | 1 | | 1 | | 1 | 1 | |
| 124 | 1 | 1 | 1 | 1 | | | | 1 | 1 | |
| 128 | 1 | 1 | 1 | 1 | | 1 | | 1 | 1 | |
| 132 | 1 | | 1 | 1 | | 1 | 1 | | | 1 |
| 136 | 1 | 1 | 1 | 1 | | | 1 | | | 1 |
| 140 | 1 | 1 | 1 | 1 | | 1 | 1 | | | 1 |
| 144 | | | 1 | | 1 | 1 | 1 | | | 1 |
| 148 | 1 | | 1 | | 1 | 1 | 1 | | | 1 |
| 152 | 1 | 1 | 1 | | 1 | | 1 | | | 1 |
| 156 | 1 | 1 | 1 | | 1 | 1 | 1 | | | 1 |
| 160 | | 1 | 1 | | 1 | | | 1 | | 1 |
| 164 | 1 | 1 | 1 | | 1 | | | 1 | | 1 |
| 168 | 1 | 1 | 1 | | 1 | 1 | | 1 | | 1 |
| 172 | 1 | | | 1 | 1 | | | 1 | | 1 |
| 176 | 1 | 1 | 1 | | 1 | | 1 | 1 | | 1 |
| 180 | | 1 | | 1 | 1 | 1 | | 1 | | 1 |
| 184 | 1 | 1 | | 1 | 1 | 1 | | 1 | | 1 |
| 188 | 1 | | 1 | 1 | 1 | | | 1 | | 1 |
| 192 | 1 | 1 | | 1 | 1 | | 1 | 1 | | 1 |
| 196 | 1 | 1 | 1 | 1 | 1 | | | 1 | | 1 |
| 200 | 1 | 1 | 1 | 1 | 1 | 1 | | 1 | | 1 |
| 204 | | 1 | 1 | 1 | 1 | | 1 | 1 | | 1 |
| 208 | 1 | 1 | 1 | 1 | 1 | | 1 | 1 | | 1 |
| 212 | 1 | 1 | 1 | 1 | 1 | 1 | 1 | 1 | | 1 |
| 216 | 1 | 1 | 1 | 1 | 1 | 1 | | | 1 | 1 |
| 220 | | 1 | 1 | 1 | 1 | | 1 | | 1 | 1 |
| 224 | 1 | 1 | 1 | 1 | 1 | | 1 | | 1 | 1 |
| 228 | 1 | 1 | 1 | 1 | 1 | 1 | 1 | | 1 | 1 |
| 232 | | 1 | 1 | 1 | 1 | | | 1 | 1 | 1 |
| 236 | 1 | 1 | 1 | 1 | 1 | | | 1 | 1 | 1 |
| 240 | 1 | 1 | 1 | 1 | 1 | 1 | | 1 | 1 | 1 |
| 244 | | 1 | 1 | 1 | 1 | | 1 | 1 | 1 | 1 |
| 248 | 1 | 1 | 1 | 1 | 1 | | 1 | 1 | 1 | 1 |
| 252 | 1 | 1 | 1 | 1 | 1 | 1 | 1 | 1 | 1 | 1 |
| | SUBFIELD BLOCK 1 | | | | | SUBFIELD BLOCK 2 | | | | |

FIG.9

| GRAY LEVEL | SF1 1 | SF2 2 | SF3 4 | SF4 8 | SF5 16 | SF6 24 | SF7 32 | NON-UNIFORM NON-ILLUMINATION PERIOD | SF8 32 | SF9 32 | SF10 32 | SF11 32 | SF12 32 |
|---|---|---|---|---|---|---|---|---|---|---|---|---|---|
| 0 | | | | | | | | | | | | | |
| 1 | 1 | | | | | | | | | | | | |
| 3 | 1 | 1 | | | | | | | | | | | |
| 7 | 1 | 1 | 1 | | | | | | | | | | |
| 15 | 1 | 1 | 1 | 1 | | | | | | | | | |
| 31 | 1 | 1 | 1 | 1 | 1 | | | | | | | | |
| 55 | 1 | 1 | 1 | 1 | 1 | 1 | | | | | | | |
| 87 | 1 | 1 | 1 | 1 | 1 | 1 | 1 | | | | | | |
| 119 | 1 | 1 | 1 | 1 | 1 | 1 | 1 | | 1 | | | | |
| 151 | 1 | 1 | 1 | 1 | 1 | 1 | 1 | | 1 | 1 | | | |
| 183 | 1 | 1 | 1 | 1 | 1 | 1 | 1 | | 1 | 1 | 1 | | |
| 215 | 1 | 1 | 1 | 1 | 1 | 1 | 1 | | 1 | 1 | 1 | 1 | |
| 247 | 1 | 1 | 1 | 1 | 1 | 1 | 1 | | 1 | 1 | 1 | 1 | 1 |

SUBFIELD NUMBER

LUMINANCE WEIGHT

SUBFIELD BLOCK 1

SUBFIELD BLOCK 2

FIG.12

(A)

GRAY LEVEL

LUMINANCE WEIGHT

| | SF1 | SF2 | SF3 | SF4 | SF5 | SF6 | SF7 | NON-UNIFORM NON-ILLUMINATION PERIOD | SF8 | SF9 | SF10 | SF11 | SF12 |
|---|---|---|---|---|---|---|---|---|---|---|---|---|---|
| | 1 | 2 | 4 | 8 | 16 | 24 | 32 | | 32 | 32 | 32 | 32 | 32 |
| 0 | | | | | | | | | | | | | |
| 1 | 1 | | | | | | | | | | | | |
| 3 | 1 | 1 | | | | | | | | | | | |
| 7 | 1 | 1 | 1 | | | | | | | | | | |
| 15 | 1 | 1 | 1 | 1 | | | | | | | | | |
| 31 | 1 | 1 | 1 | 1 | 1 | | | | | | | | |
| 47 | 1 | 1 | 1 | | 1 | 1 | | | | | | | |
| 71 | 1 | 1 | 1 | 1 | | 1 | 1 | | | | | | |
| 95 | 1 | 1 | 1 | 1 | 1 | | 1 | | 1 | | | | |
| 127 | 1 | 1 | 1 | | | 1 | 1 | | 1 | 1 | | | |
| 159 | 1 | 1 | 1 | 1 | 1 | | 1 | | 1 | 1 | 1 | | |
| 191 | 1 | 1 | 1 | | | 1 | 1 | | 1 | 1 | 1 | 1 | |
| 223 | 1 | 1 | 1 | 1 | 1 | | 1 | | 1 | 1 | 1 | 1 | 1 |

SUBFIELD BLOCK 1 SUBFIELD BLOCK 2

(B)

| | SF1 | SF2 | SF3 | SF4 | SF5 | SF6 | SF7 | NON-UNIFORM NON-ILLUMINATION PERIOD | SF8 | SF9 | SF10 | SF11 | SF12 |
|---|---|---|---|---|---|---|---|---|---|---|---|---|---|
| | 1 | 2 | 4 | 8 | 16 | 24 | 32 | | 32 | 32 | 32 | 32 | 32 |
| 0 | | | | | | | | | | | | | |
| 1 | 1 | | | | | | | | | | | | |
| 3 | 1 | 1 | | | | | | | | | | | |
| 7 | 1 | 1 | 1 | | | | | | | | | | |
| 15 | 1 | 1 | 1 | 1 | | | | | | | | | |
| 31 | 1 | 1 | 1 | 1 | 1 | | | | | | | | |
| 47 | 1 | 1 | 1 | | 1 | 1 | | | | | | | |
| 71 | 1 | 1 | 1 | 1 | | 1 | 1 | | | | | | |
| 95 | 1 | 1 | 1 | 1 | 1 | | 1 | | 1 | | | | |
| 127 | 1 | 1 | 1 | 1 | 1 | | 1 | | 1 | 1 | | | |
| 159 | 1 | 1 | 1 | 1 | 1 | | 1 | | 1 | 1 | 1 | | |
| 191 | 1 | 1 | 1 | 1 | 1 | | 1 | | 1 | 1 | 1 | 1 | |
| 223 | 1 | 1 | 1 | 1 | 1 | | 1 | | 1 | 1 | 1 | 1 | 1 |

SUBFIELD BLOCK 1 SUBFIELD BLOCK 2

(C)

| | SF1 | SF2 | SF3 | SF4 | SF5 | SF6 | SF7 | NON-UNIFORM NON-ILLUMINATION PERIOD | SF8 | SF9 | SF10 | SF11 | SF12 |
|---|---|---|---|---|---|---|---|---|---|---|---|---|---|
| | 1 | 2 | 4 | 8 | 16 | 24 | 32 | | 32 | 32 | 32 | 32 | 32 |
| 0 | | | | | | | | | | | | | |
| 1 | 1 | | | | | | | | | | | | |
| 3 | 1 | 1 | | | | | | | | | | | |
| 7 | 1 | 1 | 1 | | | | | | | | | | |
| 15 | 1 | 1 | 1 | 1 | | | | | | | | | |
| 31 | 1 | 1 | 1 | 1 | 1 | | | | | | | | |
| 47 | 1 | 1 | 1 | | 1 | 1 | | | | | | | |
| 71 | 1 | 1 | 1 | 1 | | 1 | 1 | | | | | | |
| 95 | 1 | 1 | 1 | | 1 | 1 | 1 | | 1 | | | | |
| 127 | 1 | 1 | 1 | | | 1 | 1 | | 1 | 1 | | | |
| 159 | 1 | 1 | 1 | | | 1 | 1 | | 1 | 1 | 1 | | |
| 191 | 1 | 1 | 1 | | | 1 | 1 | | 1 | 1 | 1 | 1 | |
| 223 | 1 | 1 | 1 | | | 1 | 1 | | 1 | 1 | 1 | 1 | 1 |

SUBFIELD BLOCK 1 SUBFIELD BLOCK 2

GRADATION DISPLAY METHOD CAPABLE OF EFFECTIVELY DECREASING FLICKERS AND GRADATION DISPLAY

TECHNICAL FIELD

The present invention relates to a gray scale display method for displaying gray scale using a display apparatus whose display is based on binary display, such as a plasma display panel; and to the display apparatus.

BACKGROUND ART

Image display apparatuses which use display panels whose display is based on a binary illumination system, represented here by plasma display panels (hereinafter referred to as "PDPs"), achieve gray scale by methods such as a method which divides each field of an image into a plurality of subfields, gives each subfield a predetermined luminance weight, and controls whether illumination is ON or OFF in each subfield. For example, in order to display 256 gray scale, each field of an input image signal is divided into 8 subfields which are assigned luminance weights 1, 2, 4, 8, 16, 32, 64, and 128 respectively, and arranged in order of these luminance weights. Then, each bit of an input image signal, which is assumed to be an 8 bit digital signal here, is allocated to the eight weighted subfields in order from the lowest bit, and displayed. That is to say that, illumination is either ON or OFF in each subfield, with 256 gray scale being displayed by arbitrary combinations of the weights. However, in this kind of conventional method of displaying 256 gray scale using eight subfields, flicker components can be observed when the frequency of each frame is around 50 Hz, such as in the PAL (Phase Alternation Line) system. Particularly in large screen display such flicker components are perceived as surface flickers observed over the whole screen, causing a remarkable loss of picture quality. In contrast, flickers are not felt if the field frequency is doubled by signal processing to 100 Hz. Likewise, occurrence of flickers can be controlled by keeping the frequency at the original 50 Hz, and increasing the speed of illumination. This can be achieved by simply doubling the number of subfields to 16 subfields assigned, for example respective luminance weights 1, 2, 4, 8, 16, 32, 64, 128, 1, 2, 4, 8, 16, 32, 64, and 128, and doubling the number of illuminations.

However, in either of these conventional methods the actual emission response speed in the display apparatus must be doubled, meaning the these methods can not always be implemented in plasma display panels in which operation speed is a problem. Furthermore, even if the speed of the display could be increased, a problem still remains that there is no time margin to increase picture quality to enhance performance overall by improving the quality of moving images by making use of the speed response characteristics, improving luminance, and so on.

In particular, in PDPs and the like constraints in cell discharge characteristics and so on mean that there is a limit to how much speed can be increased. As a result, the value of the highest number of subfields that can be set is limited. In addition, in controlling gray scale by controlling subfields, whose possible maximum number is limited, problems arise such as gray level irregularities when moving images are displayed. Therefore, it is not appropriate to perform subfield emission control with the amount of flickers generated being the sole criterion.

DISCLOSURE OF THE INVENTION

The present invention was invented in order to overcome the above-described problems, and with a main purpose of providing a gray scale display method that is capable of effectively controlling the amount of flickers generated, without increasing the number of subfields, in a gray scale display apparatus that performs illumination in binary, a plasma display panel being representative of such a gray scale display apparatus; and providing a gray scale display apparatus that implements this method.

Furthermore, the present invention provides a gray scale display method that is capable of controlling irregularities in moving image gray scale display, while also controlling the amount of flickers generated.

In order to achieve the main objective, the present invention is a gray scale display method that divides one field into a plurality of subfields, and displays gray scale according to combinations of illumination and non-illumination in each of the plurality of subfields, wherein one of (a) a luminance weight of each of the plurality of subfields, (b) an order of the plurality of subfields, (c) an interval between illumination pulses in the plurality of subfields, (d) a non-illumination period between each of the plurality of subfields, and (e) a method of combining illumination and non-illumination in each of the plurality of the subfields is set so that a flicker component value calculated from a field frequency component of an illumination energy of each gray level is reduced, the flicker component being calculated for all the gray levels. According to this method, encoding of "ON/OFF" of each subfield in each gray level is possible taking into consideration, in response to the gray level, not only the selection of the subfield luminance weights and the arrangement thereof, but also the interval between illumination pulses in a field and the non-illumination period between subfields. Therefore, even when the frequency of a field is low, it is possible to display gray scale controlling the generation of flickers for each gray level. In particular, it is possible to have a subfield structure and encoding that attach importance to moving image display characteristics in low luminance, and to encode so that flicker component in medium and high luminance, in which flickers are easily perceived, is controlled. Note that here "reduced" means that the flicker component is reduced in comparison to when the above described items are not set (hereinafter this expression is used in the same way). Of course it is most desirable that the flicker component be a minimum.

Here, the flicker component value may be calculated from a value that is a weighted average of luminance of a plurality of adjacent pixels. According to this method, display characteristics are improved based on the flicker component value that reflects human visualization characteristics. Thus, this method is even more practical.

Here, the flicker component value may be calculated from an elementary wave component of a result of a Fourier transform of a sequence, the sequence being prescribed by a strength of each illumination pulse series and an illumination time of each illumination pulse series in one field. When the frequency of each field is approximately 50 Hz, the flicker component is considered to be the elementary wave component of the field frequency component. Therefore, by calculating the flicker component in this way, calculation can be performed easily and simply. Note this can be calculated easily by a Fourier transform using a sine function and a cosine function.

Here, the flicker component value may be an approximation of illumination according to a plurality of pulses that belong to a same subfield with a single illumination pulse. Since the strength of each illumination pulse in the same subfield is usually substantially the same strength, the illumination intervals are relatively close, and furthermore control to turn pulses ON/OFF is performed simultaneously, therefore by treating a plurality of pulses belonging to a same subfield as one pulse of a predetermined amplitude, it is even easier to calculate the flicker component without a loss of accuracy.

Furthermore, in order to achieve the second objective, the present invention is a gray scale display method that displays gray scale according to combinations of illumination and non-illumination in each of a plurality of subfields, wherein one of (a) a luminance weight of each of the plurality of subfields, (b) an order of the plurality of subfields, (c) a non-illumination period between each of the plurality of subfields, and (d) a method of combining the illumination and non-illumination in each of the plurality of the subfields is prescribed according to both of a flicker phenomenon caused by a field frequency component on and illumination energy that has been calculated for each of a plurality of gray levels, and a value of gray level irregularities calculated for each gray level that occur when a moving image is displayed. According to this method, flickers and false edges, between which a balance must be struck, are evaluated simultaneously and controlled for each gray level. This improves the balance between the two, and allows favorable image display.

Here, the gray level irregularities may be approximated with one of (e) the luminance weight of a subfield that is turned OFF accompanying an increase in the gray level value, and (f) the luminance weight of a subfield that is turned ON accompanying a decrease in the gray level value.

Here, the gray level irregularities may be approximated with a highest luminance that is ON when the display gray level is displayed.

Furthermore, in order to achieve the main object, the present invention is a gray scale display apparatus that divides one field into a plurality of subfields, and displays gray scale according to combinations of illumination and non-illumination in each of the plurality of subfields, wherein the gray scale display apparatus is constructed so that a flicker component value calculated from a field frequency component of an actual illumination energy of each gray level in displayed gray scale is no higher than a reference value, the reference value being a flicker component value calculated from a field frequency component of an illumination energy of each gray level when a single illumination pulse is assumed in one field for display illumination in the gray level, and a ratio of the flicker component value calculated from a field frequency component of an actual illumination energy in the gray level is low when the gray level is high, and is high when the gray level is low. According to this construction, it is possible to maintain favorable moving image display characteristics by reducing restrictions of flicker control in low luminance that does not greatly affect flicker generation, while performing relative flicker control in medium and high luminance in which flicker components are easily recognized. Therefore, favorable image display can be achieved across all luminance areas.

Here, when a gray level is equal to or less than one third of a highest possible gray level value, the ratio may be equal to or less than two thirds.

Here, when a gray level is equal to or less than two thirds of a highest possible gray level value, the ratio may be equal to or less than one half.

Furthermore, the present invention is a gray scale display apparatus that displays gray scale according to combinations of illumination and non-illumination in each of a plurality of subfields, wherein each of the plurality of subfields is composed of at least a first block and a second block of differing structures, respective subfields in both the first block and the second block being arranged in a same one of ascending order and descending order of respective luminance weights, and one of (a) a luminance weight of each of the plurality of subfields, (b) an order of the plurality of subfields, (c) a non-illumination period between each of the plurality of subfields, and (d) a method of combining the illumination and non-illumination in each of the plurality of the subfields is prescribed so that a flicker component value calculated from a field frequency component of an illumination energy of each gray level calculated for each of a plurality of preset displayed gray levels is reduced. According to this construction, flickers are not controlled by simply doubling the number of subfields using blocks of the same construction. Instead luminance weight between the subfields, the non-illumination period between subfields or the method of combining illumination and non-illumination in the subfields are varied. Thus, it is possible to select subfield luminance weights, non-emission periods between subfields, or a method of combining illumination and non-illumination in subfields so as to strike a balance between gray scale display that has favorable display characteristics, and flicker component control.

Furthermore, the present invention is a gray scale display apparatus that displays gray scale according to combinations of illumination and non-illumination in each of the plurality of subfields, wherein the plurality of subfields is composed of at least a first block and a second block, the blocks being different, and the respective subfields in both of the blocks being arranged in one of ascending order and descending order of luminance weight. According to this construction, flickers are not controlled by simply doubling the number of subfields using blocks of the same construction. Instead luminance weight between the subfields, the non-illumination period between subfields or the method of combining illumination and non-illumination in the subfields are varied. Thus, it is possible to select subfield luminance weights, non-emission periods between subfields, or a method of combining illumination and non-illumination in subfields so as to strike a balance between gray scale display that has favorable display characteristics, and flicker component control.

Here, the first block and the second block may be composed of different amounts of subfields.

Here, in the first block and the second block may each include at least one subfield whose luminance weight is different to the luminance weight of each of the subfields in the other block.

Here, at least two lowest subfields in ascending order of luminance weights of the plurality of subfields may be selected substantially in order of luminance weight and arranged in succession at a head of the first block, and remaining subfields may be distributed alternately between and arranged in ascending order of luminance weight in the first block and the second block.

Here, at least two lowest subfields in ascending order of luminance weights of the plurality of subfields are selected in substantially order of luminance weight may be arranged in succession at an end of the first block, and remaining subfields may be distributed alternately between and arranged in descending order of luminance weight in the first block and the second block.

According to this construction, subfields which have high luminance weight are arranged dispersed between a plurality of blocks. Thus, the illumination positions in the medium and high luminance areas are dispersed, and illumination energy field frequency component, in other words flicker component, can be easily controlled. In addition, subfields whose luminance weight is low and that influence moving image display characteristics in low luminance, and that do not have a dominant influence in flicker generation, are arranged concentrated in one block. Thus, movement of illumination patterns in low luminance display characteristics is limited to a narrow range, and favorable moving image display characteristics can be maintained in low luminance. In other words, according to the aforementioned construction, a balance can be struck between maintaining favorable moving image display characteristics in low luminance and control of generation of flickers.

Here, a highest luminance weight of the subfields included in each of the first block and the second block may be substantially a same luminance weight. According to this construction, illumination that has a large influence on flicker component in high luminance display is dispersed between a plurality of blocks, therefore encoding that controls flicker component in high luminance can be performed easily.

Here, a ratio of the luminance weight of the subfield in each of the first block and the second block having the highest luminance weight may be closer to one than a ratio of the subfields in the first block and the second block having the second highest luminance weights. According to this construction, illumination that has a large influence on flicker component in high luminance display is dispersed between a plurality of blocks, therefore encoding that controls flicker component in high luminance can be performed easily.

Furthermore, in order to achieve the main object of the present invention, the present invention is a gray scale display apparatus that divides one field into a plurality of subfields, and displays gray scale display according to combinations of illumination and non-illumination in each of the plurality of subfields, wherein the gray scale display apparatus displays by limiting the gray scale so that a flicker component value calculated from a field frequency component of an actual illumination energy of each gray level is no higher than a reference value, the reference value being a flicker component value calculated from a field frequency component of an illumination energy of each gray level when a single illumination pulse is assumed in one field for display illumination in the gray level. According to this construction, the gray level that is to be actually displayed by each pixel is only displayed for gray levels that generate few flickers. Gray levels that generate a lot of flickers can be substituted with gray levels that generate few flickers by a method such as performing error diffusion display between neighboring pixels. Thus, gray scale display that in real terms controls generation of flickers in all gray levels is possible.

Furthermore, yet another object of the present invention is to provide a flicker calculation or estimation method that is one means for implementing the above described method and apparatus.

In order to achieve this object, the present invention is a flicker calculation method for calculating or estimating a flicker component in a gray scale display apparatus that divides one field into a plurality of subfields, and displays gray scale display according to combinations of illumination and non-illumination in each of the plurality of subfields, wherein the method calculates or estimates, as a flicker component, a field frequency component of a result of a Fourier transform of a sequence prescribed by a strength of each illumination pulse series in the field and an illumination time of each illumination pulse series in the field.

Furthermore, the present invention is a flicker calculation method for calculating or estimating a flicker component in a gray scale display apparatus that divides one field into a plurality of subfields and displays gray scale display according to combinations of illumination and non-illumination in each of the plurality of subfields, wherein the method calculates or estimates, as the flicker component, illumination according to a plurality of pulses in each of the subfields is substituted with a sequence approximated with illumination according to single pulses, and a field frequency component of a result of a Fourier transform of the sequence.

BRIEF DESCRIPTION OF THE DRAWINGS

FIG. 3 shows the encoding method of the subfield information generation unit of the above-described structure;

FIG. 7 shows another encoding method in the subfield information generation unit of the above-described construction;

FIG. 9 shows subfield structures and subfield ON/OFF combinations in predetermined gray levels in a gray scale display apparatus of the second embodiment of the present invention;

FIG. 12 shows subfield structures and subfield ON/OFF combinations in predetermined gray levels in a gray scale display apparatus of a third embodiment of the present invention (FIG. 12A) and comparison examples (FIGS. 12B and 12C);

BEST MODE FOR CARRYING OUT THE INVENTION

The following describes embodiments of the present invention in detail, with reference to the drawings.

First Embodiment

Figure 1:
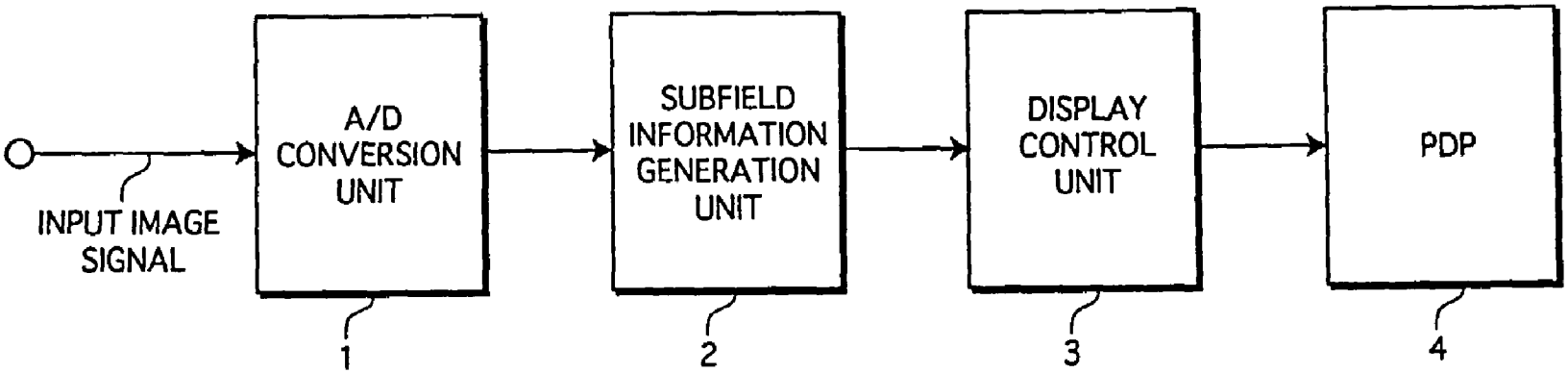
FIG. 1 is a block drawing showing the structure of a gray scale display apparatus in the first embodiment of the present invention.

FIG. 1 is a block drawing showing the structure of the image display apparatus in the present embodiment of the present invention.

As shown in FIG. 1, the image display apparatus of the present embodiment is composed of an AD conversion unit 1, a subfield information generation unit 2, a display control unit 3, and a PDP 4.

The PDP 4 is a display apparatus that has electrodes arranged in a matrix, and is composed, for example, of (640 pixels/1 line)×480 pixels. Illumination is performed in binary, with each pixel being either ON or OFF. Here, gray levels are displayed by expressing each gray level as a total of the illumination values for a predetermined time period, namely, a predetermined number of subfields (for example, 12 subfields), where each subfield is assigned a predetermined number of illumination pulses as a weight. This is how intermediate tones are displayed. Note that a PDP for monochrome display is described in the present embodiment for simplicity, though the technique of the present embodiment can also be applied to the processing of each color in PDPs for color display which generate pixels using the three colors red (R), green (G), and blue (B).

The AD conversion unit 1 is a circuit that converts an analog image signal to digital image signal having a predetermined number of bits (for example, 8 bits, or 12 bits for higher image resolution).

Figure 2:
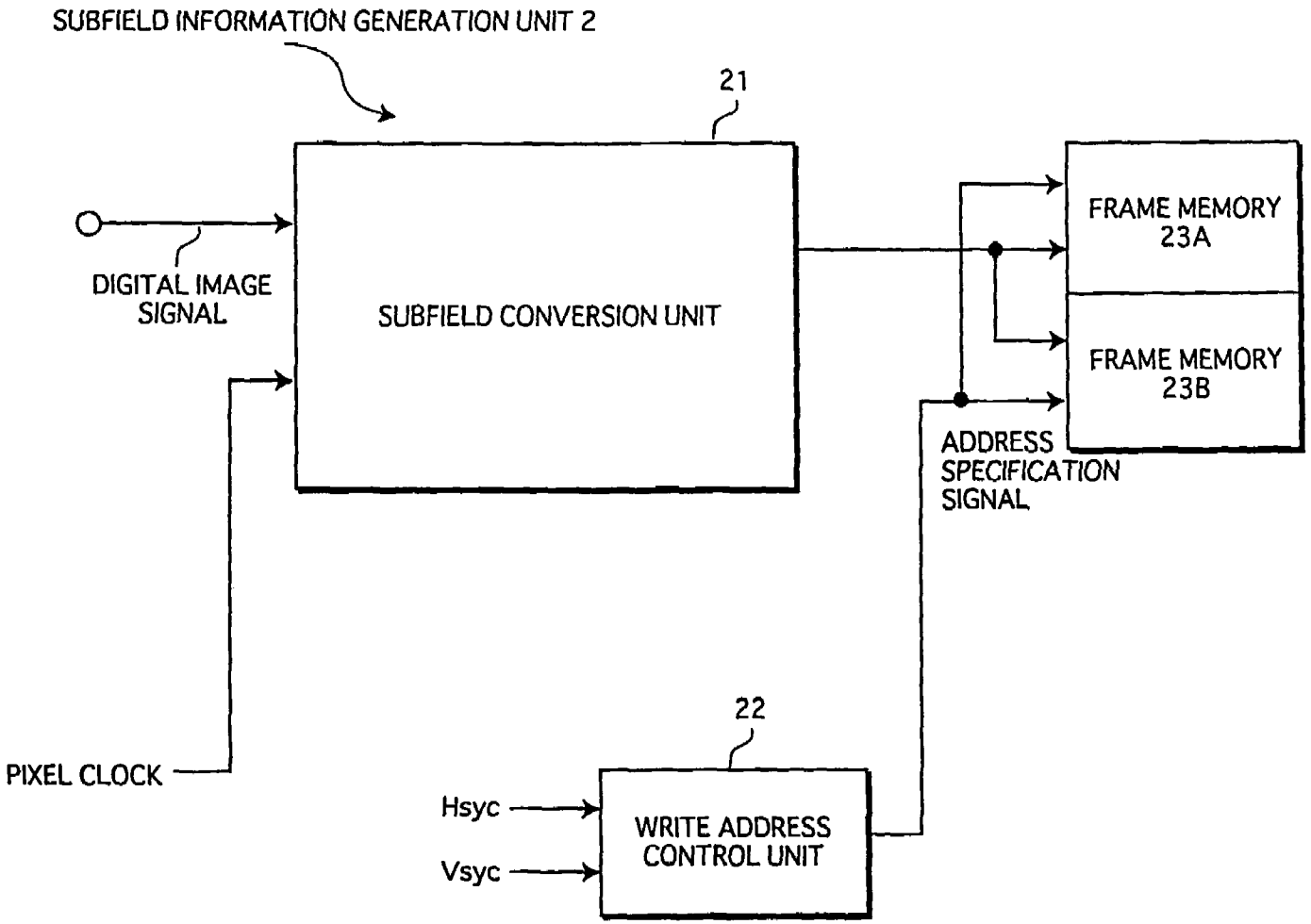
FIG. 2 is a block drawing showing the structure of the subfield information generation unit in the above-described structure.

FIG. 2 is a block drawing showing the structure of the subfield information generation unit 2.

As the drawing shows, the subfield information generation unit 2 is composed of a subfield conversion unit 21, a write address control unit 22, and frame memories 23A and 23B.

The write address control unit 22 generates an address specification signal for specifying a frame memory write address based on a horizontal synchronization signal and a vertical synchronization signal that have been separated from an input analog image signal.

The subfield conversion unit 21 is a circuit which converts the digital image signal corresponding to each pixel into subfield information having a predetermined weight. Here the subfield information is 12 bits.

The subfield information is a collection of single bits that show whether each time zone in a field (here, a PAL system 50 Hz field is assumed), in other words which subfields, should be ON or OFF. When generating this kind of subfield information, it is usual to use a look-up table in which information to be converted in response to the gray level of the input digital image signal is in correspondence. The subfield information generation process for each pixel is performed in synchronization with a pixel clock generated by a PLL circuit (not illustrated).

The subfield information that is generated for each pixel is written into the physical address in the frame memories 23A and 23B that are specified by the address specification signal output by the write address control unit 22. Here, the data is written for each line, pixel, field, and screen.

The encoding method used by the subfield conversion unit 21, in other words, the structure of subfields, is shown in FIG.

3. The column on the left in FIG. 3 indicates gray levels of the input image signal, and the columns next to this column show ON/OFF information of subfields to be converted. Note that subfields having a value "1" indicate that the pixels are ON during the subfield, while subfields without the value indicate that the pixels are OFF during the subfields (such expressions are used hereinafter).

This encoding converts each input image signal into 12 bit ON/OFF information for subfields SF1 to SF12 which are assigned the luminance weights of 1, 2, 4, 16, 32, 56, 4, 12, 24, 40, and 56 respectively in order of time. Note that in FIG. 3 the part corresponding to the lowest two bits of the input image signal are omitted for simplicity. Here, it is assumed that the lowest two bits are simply allocated to the first two subfields SF1 and SF2 and illuminated.

On receiving an input of a digital image signal that has a value of, for example, 96 (*1 in FIG. 3), the subfield conversion unit 21 converts (encodes) the image signal into 12 bit data "010110101000", and outputs the 12 bit data. Note that this bit expression corresponds each subfield number with the relevant digit in the bit expression.

Figure 4:
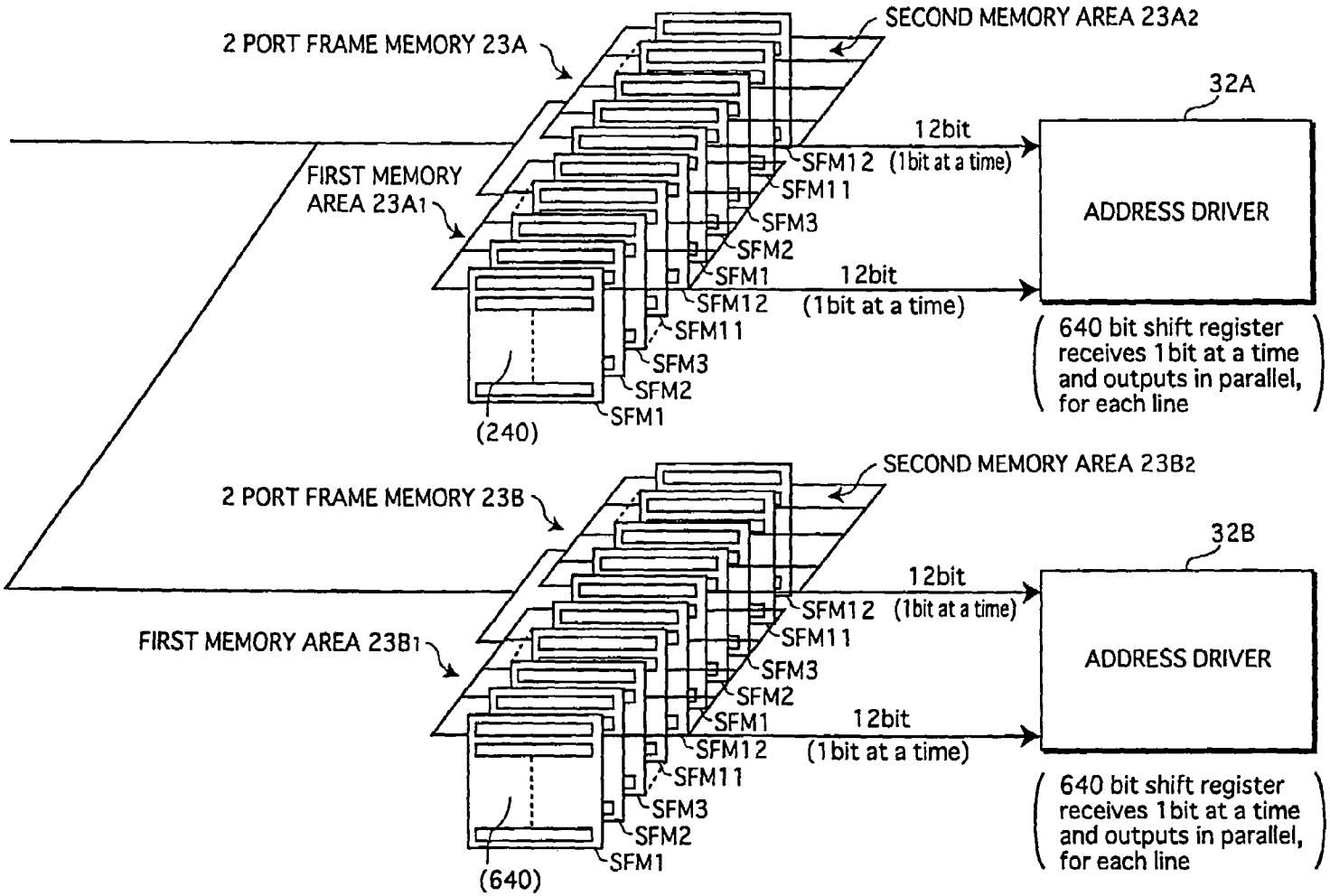
FIG. 4 is a block drawing showing the structure of the frame memory of the above-described structure.

The frame memory 23A and 23B have an internal structure shown in FIG. 4. Specifically, the frame memory 23A is composed of a first memory area 23A1 for storing subfield information of the former half (1 to L (240 lines)) of one screen, and a second memory area 23A2 for storing subfield information of the former half (1 to L (240) lines) of another screen. The frame memory 23B is composed of a first memory area 23B1 for storing subfield information of the latter half (L+1 to 2L (480) lines) of the one screen, and a second memory area 23B2 for storing subfield information of the latter half (L+1 to 2L (480) lines) of the other screen.

In addition, the first memory area 23A1 (first memory area 23B1) and the second memory area 23A2 (second memory area 23B2) are each composed of twelve subfield memories SFM1 to SFM12. With this construction, each memory area, in total, stores field information covering two screens for each of the 12 subfields, with each piece of subfield information indicating ON/OFF of a corresponding pixel. In the present embodiment, a semiconductor memory of "one-bit-input, one-bit-output" type is used as each of the subfield memories, SFM1 to SFM12. The frame memories 23A and 23B are two-port frame memories which are capable of simultaneously writing field information into themselves and reading field information to the PDP 4.

Field information is alternately written into the memory areas 23A1, 23B1, 23A2, and 23B2, such that field information of a former half of a present screen is written into the first memory area 23A1; a latter half of the screen is written into the first memory area 23B1; a former half of another screen is written into the second memory area 23A2; and a latter half of the screen is written into the second memory area 23B2. In writing field information into one memory area (23A1, 23A2, 23B1, or 23B2), each bit of the 12-bit data output from the subfield conversion unit 21 in synchronization with the pixel clock is sequentially written into the subfield memories, SFM1 to SFM12. Here, it is predetermined which of 12 bits is to be stored into which of the subfield memories, SFM1 to SFM12.

More specifically, subfield numbers 1 to 12 are logically associated with the subfield memories SFM 1 to SFM 12.

Accordingly, the 12 bits of the 12-bit data are written into respective subfield memories out of SFM 1 to SFM 12. A write position of the 12-bit data in the subfield memories SFM 1 to SFM 12 is specified by the addressing signal outputted from the write address control unit 22. Usually, the 12-bit data is written into the same position as the position of the pixel signal on the screen before the pixel signal is converted into the 12-bit data.

Figure 5:
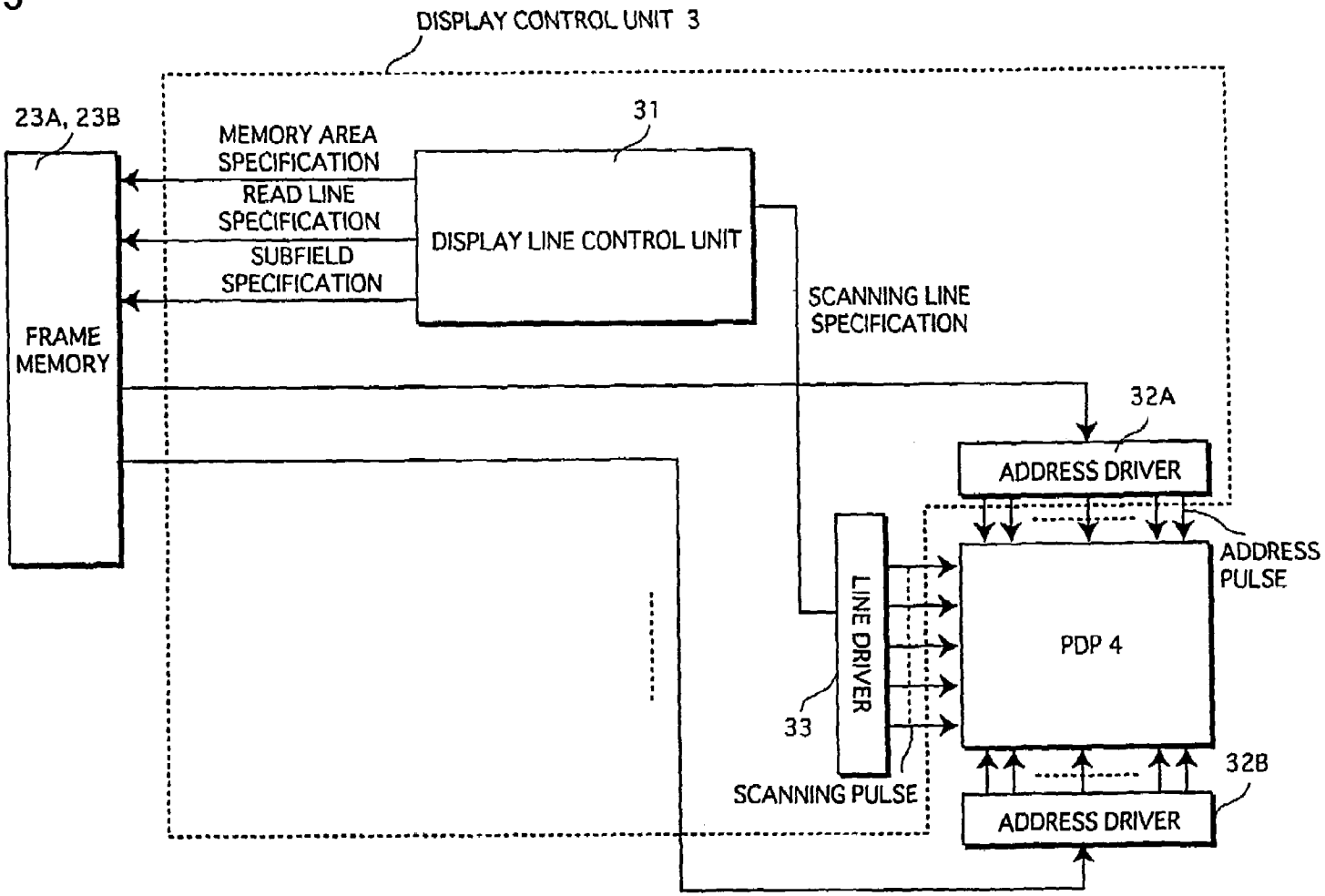
FIG. 5 is a block drawing of the structure of the display control unit of the above-described structure.

The display control unit 3, as shown in FIG. 5, is composed of a display line control unit 31, address drivers 32A and 32B, and a line driver 33.

The display line control unit 31 tells the frame memories 23A and 23B which memory area (23A1, 23A2, 23B1, or 23B2), line and subfield should be read to the PDP 4, and tells the PDP 4 which line should be scanned.

The operation of the display control unit 31 is synchronized, in a screen unit, with the operation of writing data into the frame memories 23A and 23B in the subfield information generation unit 2. Namely, the display line control unit 31 does not read data from the memory areas 23A1 and 23B1 (23A2 and 23B2) into which 12-bit data is being written, but reads data from the other memory areas 23A2 and 23B2 (23A1 and 23B1) into which 12-bit data has already been written.

The address driver 32A converts subfield information into address pulses in parallel in units of lines, each line having 640 bits, and outputs the address pulses as a line in the former part of a screen. Note that the 640-bit subfield information is serially input to the address driver 32A in one-bit units in accordance with memory area specification, line specification, and subfield specification by the display line control unit 31. The address driver 32B converts subfield information into address pulses in parallel units of lines, and outputs the address pulses as a line in the latter part of the screen.

The line driver 33 generates scan pulses to specify lines of the PDP 4 to which the subfield information is to be written.

With this construction of the display control unit 3, subfield information is read from the frame memories 23A and 23B to the PDP 4 as follows. For the subfield information, two pieces of data for the former half and the latter half of one screen are simultaneously read from the frame memories 23A and 23B, respectively. First, subfield information is read from the two subfield memories SFM1 simultaneously. Starting from the first line, subfield information for each pixel is read bit by bit, in order from one line to another from the memory areas 23A1 and 23B1 for two parts of a screen, simultaneously. After the first line is specified by the line driver 33, latent images are formed (addressing is carried out) on the first lines of the former and latter parts of the screen. Similarly, the process is repeated for each pair of lines, outputting the subfield information to the PDP 4 in parallel and carrying out addressing, until the last pair of lines for the respective parts of the screen are completed, when each pixel on the screen is simultaneously illuminated. During the illumination periods a number of discharge sustaining pulses proportional to the pre-allocated luminance weight of each subfield is applied between each pair of electrodes composing each pixel. Here, only the pixels whose illumination has been specified by address specification are illuminated.

Similarly, ON/OFF subfield information for the subfield SF2 for each pixel of each line is read from the subfield memories SFM2, and each addressing is carried out. The same operation is successively repeated for the rest of the subfields. On completing this operation for all the subfields SF 1 to SF 12 for the first memory areas 23A1 and 23A2, the read-out (writing) of field information for one screen ends.

The following describes characteristics of the encoding performed by the subfield information generation unit 2, and the workings and effects of the encoding.

In the encoding of the subfield information, the number of subfields is twelve. The subfields are assigned luminance weights 1, 2, 4, 8, 16, 32, 56, 4, 12, 24, 40, and 56 in order of time, with there being a first block of 1, 2, 4, 8, 16, 32, 56 and a second block of 4, 12, 24, 40, and 56. In other words, subfields whose luminance weight is small are arranged in the manner 1:2:4 at the head of the first block. Such an arrangement improves moving image display characteristics in low luminance display. FIG. 3 omits the subfields with luminance weights 1 and 2 for simplicity to illustrate the alternate distribution of the remaining subfields.

Furthermore, since the subfields are positioned in each block in ascending order of luminance, it is possible to encode combinations of subfields whose emission patterns are relatively constant in relation to continuous luminance variations. Therefore, relatively good moving image display characteristics can be expected over all luminance areas.

Moreover, since the highest luminance weight of the subfields included in each block is an equal 56, the actual emission frequency is doubled to twice the frequency of one field by dispersing the emission pulse series which is the greatest cause of flickers during display in a high luminance range, into two blocks. As a result it is easy to achieve encoding which suppresses flicker components well over medium and high luminance. Here, flicker component denotes a signal component that is a main cause of a flicker phenomenon in a human eye that watches moving image display. This has a high correlation with field frequency components in illumination, therefore it is possible to find the flicker component through, for example, a mathematical process from a sampled data series by dividing one field period into N sufficiently short intervals. A flicker component value calculated in this manner is thought to have a high correlation with the actual flicker phenomenon.

Furthermore, if other subfields with heavy luminance weight are selected successively in order from each block and the luminance weights of the two blocks compared, the result is "16:32", and "24:40". With this structure, subfields having heavier luminance weights are distributed more evenly between the blocks, therefore it is easier to encode so that the flicker component is controlled.

Figure 6:
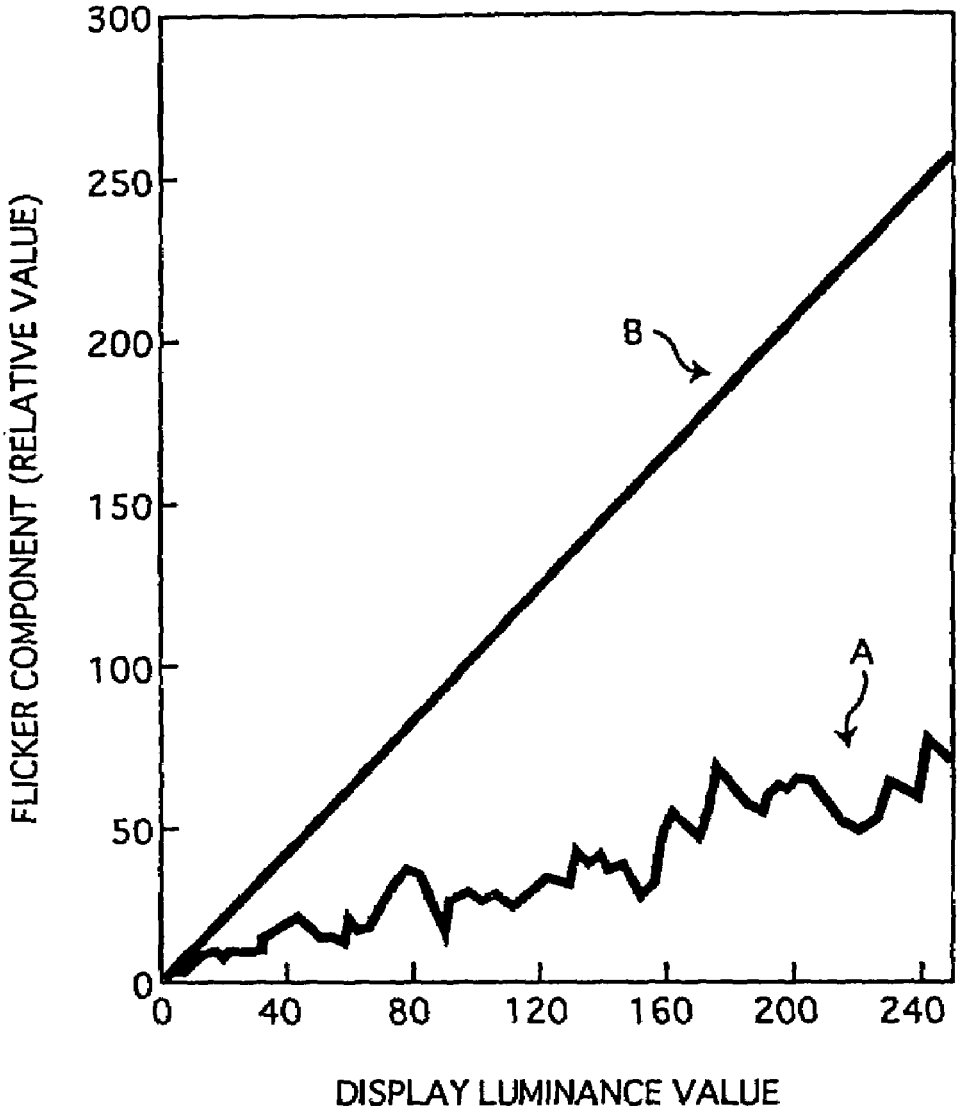
FIG. 6 is a characteristic drawing showing the relationship between gray levels and the flicker component when gray scale display is performed using the encoding in FIG. 3, compared with a CRT.

FIG. 6 is a characteristic drawing showing the relationship between display luminance values and flicker component. A line segment A shows the relationship between the display luminance and the calculated flicker component when images are displayed according to the aforementioned method. A line segment B shows the relationship between the display luminance value and the flicker component in a display device that illuminates with a single illumination pulse, such as a CRT.

As can be seen from FIG. 6, according to the gray scale display apparatus of the present embodiment, the flicker component can be expected to be reduced to approximately less than one third of that of that of a CRT in high luminance display areas, and approximately one half or less in medium luminance display areas.

Looking at these results in more detail, if the flicker component of the CRT is used as a reference value, the drawing shows that the ratio of the flicker component calculated from a field frequency component of an actual illumination energy of each gray level can be reduced in relation to the reference value. When the gray level is one third or less of the highest possible gray level, the ratio of the flicker component value to the reference value can be reduced to two thirds or less, and when the gray level is two thirds or less of the maximum possible gray level, the ratio can be reduced to one half or less.

Note that this flicker component can be found, for example, from a sampled data series obtained by dividing one field period into N sufficiently small parts. Specifically, when emission when one field is period divided into N portions is expressed $$h_k \quad \text{(Expression 1)}$$

(Numerical subscript k is a positive number in the range of $0 \leqq k \leqq N$)

and the real part component of the field frequency component is $$R_i \quad \text{(Expression 2)}$$

(Numerical subscript i is a positive number in the range of $0 \leqq i \leqq 255$)

then the real part component of the field frequency component is expressed as $$Ri = \sum_{k=0}^{N-1} h_k \cos(2\pi k / N) \quad \text{(Expression 3)}$$

Furthermore, if the imaginary part component of the field frequency is $$J_i \quad \text{(Expression 4)}$$

then the imaginary part component of the field frequency is expressed as $$Ji = \sum_{k=0}^{N-1} h_k \sin(2\pi k / N) \quad \text{(Expression 5)}$$

Hence, if the flicker component size $$F_i \quad \text{(Expression 6)}$$

is equivalent to the size of the field frequency component found above, the flicker component size can be expressed as a square root of the square of the actual part component and the square-of the imaginary part component in the following way:

$$Fi = \sqrt{Ri^2 + Ji^2}\,. \quad \text{(Expression 7)}$$

In selecting the actual luminance weight, one method that can be used to determine the actual luminance weight is to calculate the flicker component F according to the stated method, and select so that this value does not become especially great in high luminance parts, while keeping the gray scale display characteristics and moving images in mind. Furthermore, it is even more practical to calculate the value of the weighted average of the illumination of a plurality of neighboring pixels as the flicker component, rather than only one pixel, as this reflects human sight characteristics.

According to the present embodiment, favorable moving image display characteristics can be expected across all luminance areas without increasing the number of subfields. In particular, it is possible to achieve gray scale display which controls flicker characteristics favorably in medium and high luminance, where flickers are easily perceived.

Variations

1) The description of encoding into subfield information gives the number of subfields as twelve, and, as shown in FIG. 3, the subfields are assigned luminance weights 1, 2, 4, 8, 16, 32, 56, 4, 12, 24, 40, and 56 in order of time, with there being a first block of 1, 2, 4, 8, 16, 32, 56 and a second block of 4, 12, 24, 40, and 56. However, it is possible to assign luminance weights 56, 40, 24, 12, 4, 56, 32, 16, 8, 4, 2, and 1 in order of time, and have a first block and a second block of 56, 40, 24, 12, and 4, and 56, 32, 16, 8, 4, 2, and 1 respectively.

2) Furthermore, the greatest luminance weight in the two blocks does not have to be equal, but is important that the ratio of the greatest luminance weights of the two blocks be closer to one than that of the second greatest luminance weights of the two blocks. This is because the amount of flickers generated can be controlled by this kind of weighting.

3) FIG. 7 shows another encoding method in the subfield information generation unit.

As shown in the figure, the luminance weights and arrangement of the subfields are 4,8, 16, 32, 56, 4, 12, 24, 40, and 56 as described earlier. The difference is the encoding method in regard to predetermined gray levels. FIG. 7 omits the subfields with luminance weights 1 and 2 for simplicity to illustrate the alternate distribution of the remaining subfields.

In this encoding, an encoding method in which the flicker component calculated as described earlier is even lower.

Specifically, looking at the gray level 96 for example, in the above-described embodiment 96 is encoded as "010110101000", but here 96 is encoded as "010100101100" (see *2 in FIG. 7).

With to this kind of encoding, it is possible to reduce the flicker component according to the combination, even if the luminance weight is the same.

Figure 8:
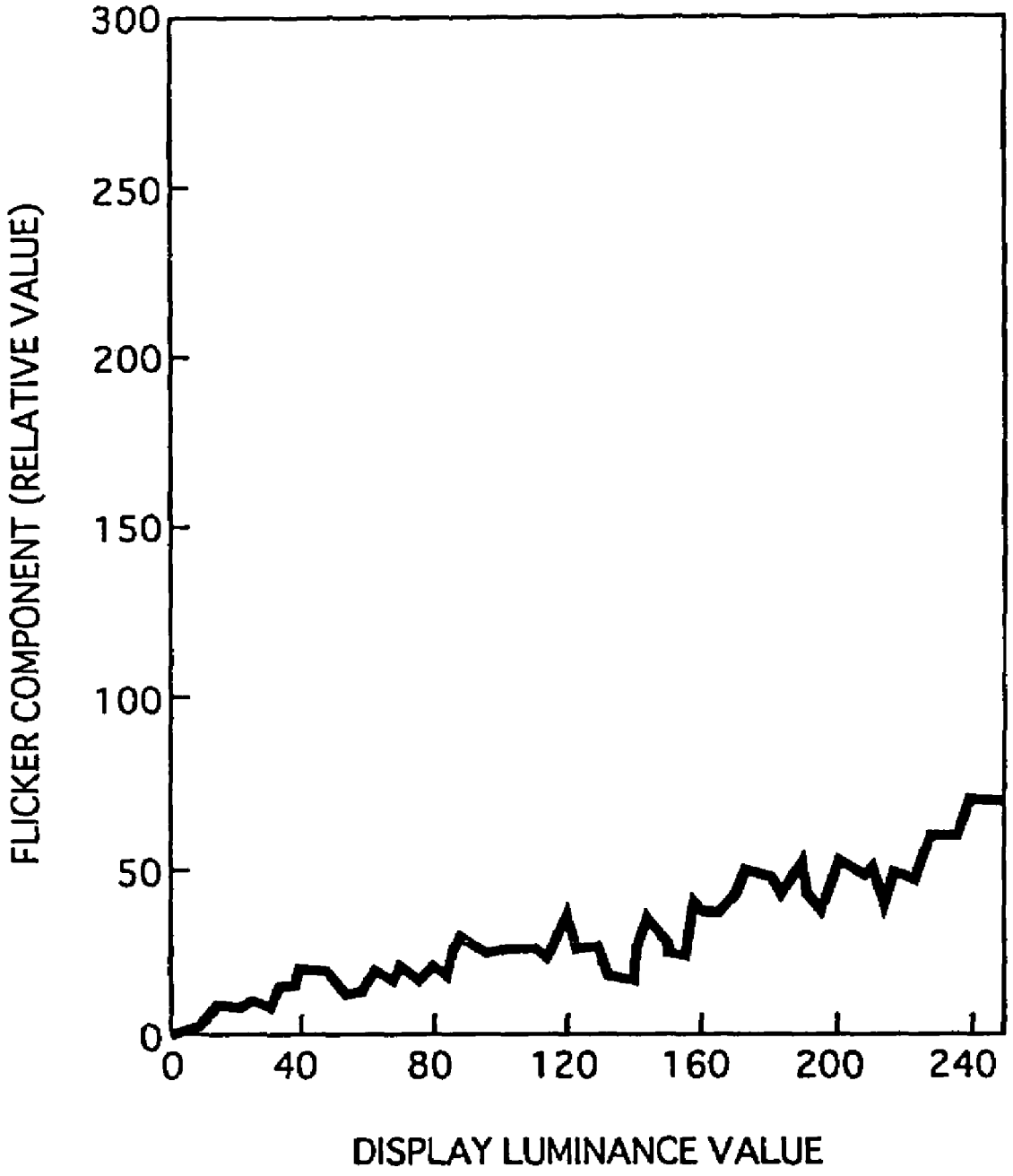
FIG. 8 is a characteristic drawing showing the relationship between the displayed luminance value and the flicker component when the encoding method in FIG. 7 is used.

Specifically, as can be seen from FIG. 8 which shows a calculated flicker component, the flicker component is reduced even more than that shown by the line component A in FIG. 6.

As has been explained, by encoding giving priority to flicker reduction, it is possible to display gray scale according to purpose, such as for a main purpose of displaying still images.

Second Embodiment

FIG. 9 shows an encoding method (subfield structure) in the subfield information generation unit of a gray scale display apparatus of the present embodiment. FIG. 9 shows the position of a non-uniform non-emission period provided between subfields, and whether each subfield emission is ON or OFF in relation to gray levels. Note that thirteen representative gray levels are shown for the gray levels.

Here, as in conventional methods in which addressing periods of a set length are sandwiched between evenly sustained illuminating, these address periods are non-illumination periods. However, a non-uniform non-illumination period denotes a non-illumination period that is longer than a length of each of plurality of other uniform non-illumination periods. Furthermore, in the present embodiment an address period is used in all the non-illumination periods, and the address period in the non-uniform non-illumination period is longer than other address periods. Note that in addition to the address period, each non-illumination period may also include other periods such as an initialization period between subfields, and an erase period.

Figure 10:
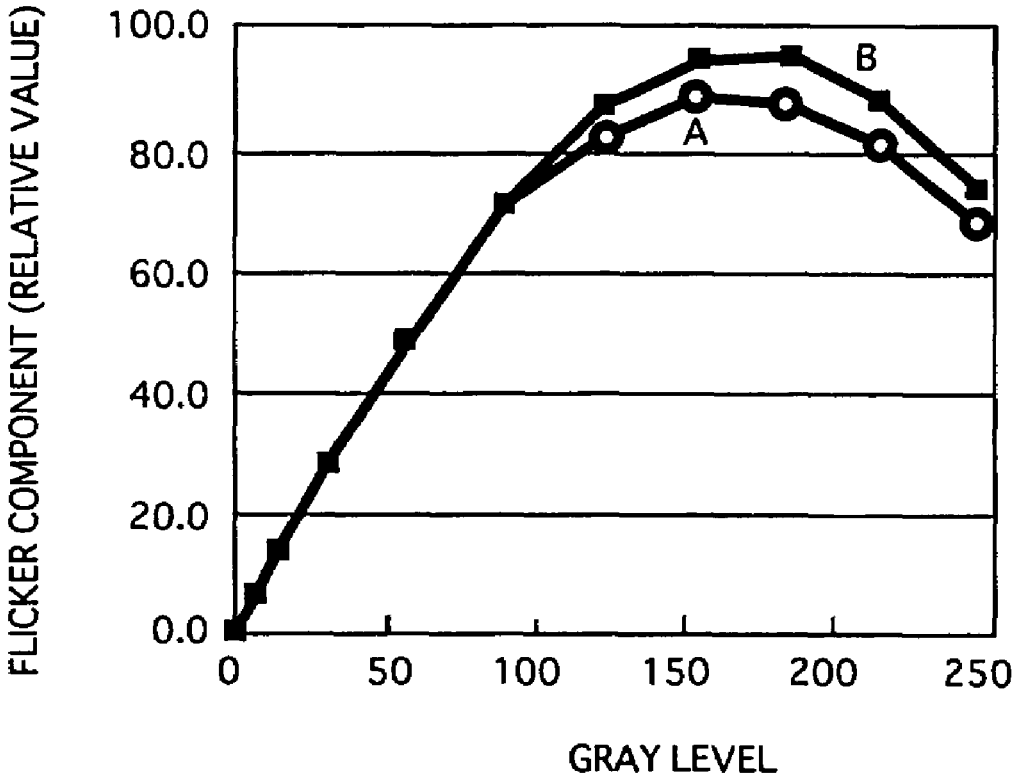
FIG. 10 is a characteristic drawing showing the relationship between the displayed luminance value and the flicker component when gray scale is displayed in the aforementioned subfields, compared with a CRT.

If subfields with such a structure are used in display, the flicker component of each gray level will have a value that is such as that shown by a line segment A in FIG. 10, as a result of the calculation method described earlier. A line segment B in FIG. 10 corresponds to the amount of flicker component generated when illumination periods are allocated having the non-illumination periods provided uniformly, in a conventional method. FIG. 10 shows that by providing the non-uniform non-illumination periods at specified positions, as shown by the line segment A, flicker components can be controlled. This is thought to be because by providing the non-illumination periods non-uniformly, the time distribution of the principle illumination is dispersed, and the illumination field frequency component, in other words the flicker component, decreases.

Note that the line segment A in FIG. 10 shows an example of when a position of a non-uniform non-illumination period of 800 ns is provided between subfields SF7 and SF8 (hereinafter "7SF–8SF" is used to denote "between subfields SF7 and SF8"; the same kind of expression is also used to denote being between other subfields).

Figure 11:
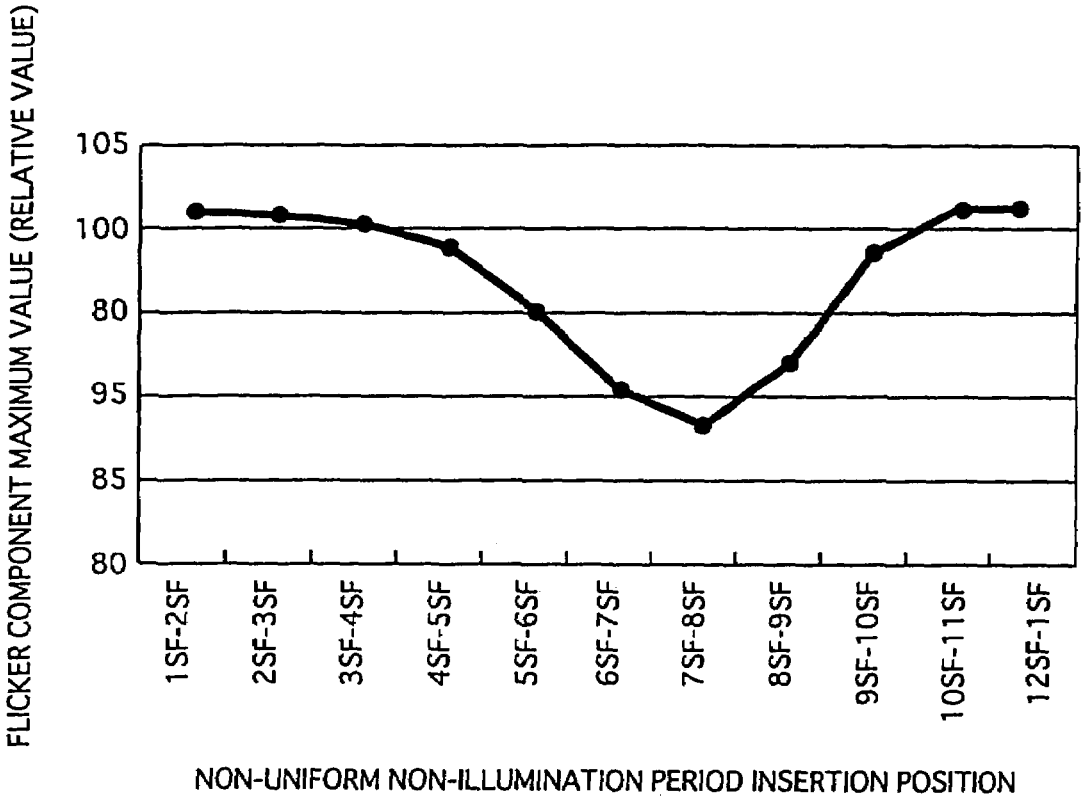
FIG. 11 is a characteristic drawing showing the relationship between the position of a non-uniform non-illumination period and flicker component.

FIG. 11 is a graph showing the variation in the flicker component when the position of the inserted non-uniform non-illumination period is changed. This graph shows that generation of flickers is suppressed most when the non-uniform non-illumination period is provided between subfields SF7 and SF8. Note that when the length of the non-illumination periods is longer and the periods are provided evenly in a field, the total length of the non-illumination periods increases, and the time that can be used for actual display within the limited field period is compressed, which means that the greatest luminance must be reduced. From this point of view, it is extremely significant that by optimizing the specified position to which the non-uniform non-illumination period is to be inserted such as in the present embodiment, the greatest flicker suppression effect can be obtained in relation to the same amount of luminance reduction.

Furthermore, in the present embodiment the non-uniform non-illumination period can be provided by lengthening a period other than the illumination period. Therefore, while performing discharge with more stability by making the pulse in the address period wider, or while stabilizing the discharge operations by lengthening the periods relating to initialization operations and erase operations, a longer non-emission period can be ensured.

Third Embodiment

FIG. 12 (A) shows the structure of a plurality of subfields of the gray scale display apparatus of the present embodiment, and shows a non-uniform non-illumination period between subfields SF7 and SF8, and whether each subfield is ON/OFF in relation to gray levels. Note that the luminance weights and the arrangement thereof are identical to those in the second embodiment.

Figure 13:
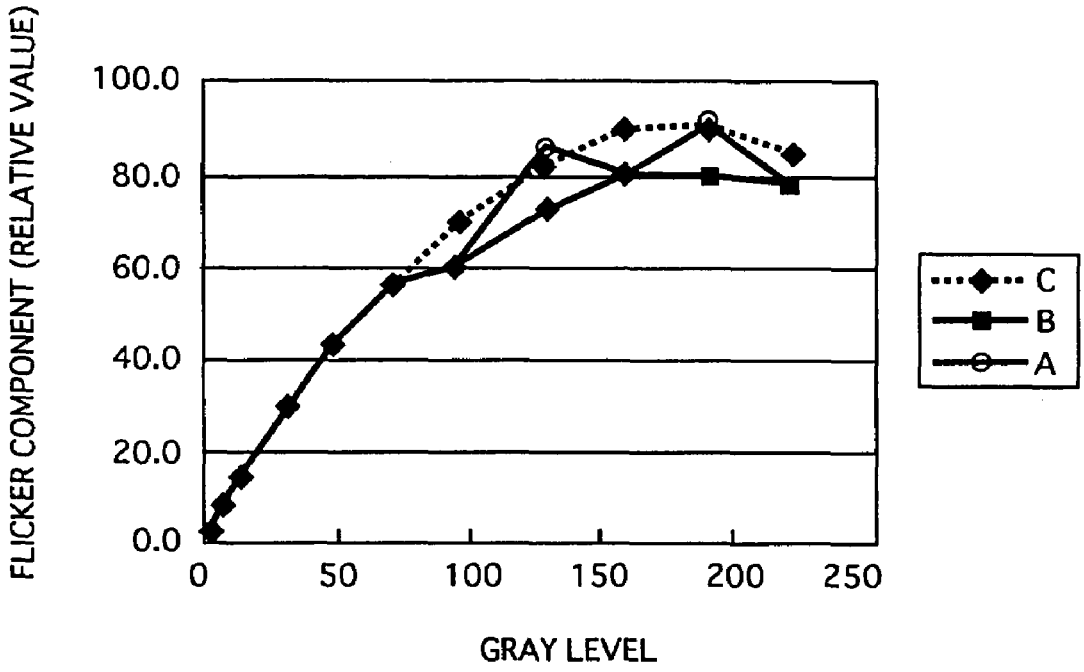
FIG. 13 is a characteristic drawing showing the relationship between display luminance values and flicker component when gray scale is displayed using the encoding method of FIG. 12.

When gray scale is displayed using subfields of this structure, it is possible to calculate the flicker component for each gray level, such as a line segment A in FIG. 13. On the other hand, when a subfield control method such as that shown in FIG. 12(B) is used, flickers can be controlled even further compared to FIG. 12(A) in the present embodiment (see line segment B, FIG. 13). However, when gray levels 95, 127, 159, 191, and 223 are displayed, subfield SF6 whose luminance weight is relatively heavy is OFF continuously. This is thought to be a cause of gray level irregularities when a moving image is displayed. Accordingly, controlling whether illumination is ON or OFF in subfields, as shown in FIG. 12A in the present embodiment, is effective in reducing the amount of flickers generated while controlling gray level irregularities in moving image display.

Note that in FIG. 12(C) both the gray level irregularities and the amount of flickers in moving image display are large (see line segment C, FIG. 13), therefore it is desirable to eliminate this kind of combination when displaying gray scale.

According to the present embodiment, it is possible to control the amount of flickers by controlling whether the subfields are ON or OFF while taking into consideration gray level irregularities in moving image display.

Needless to say, the flicker component in the first embodiment can be effectively controlled even further by combining the contents of the second and third embodiments.

Fourth Embodiment

Figure 14:
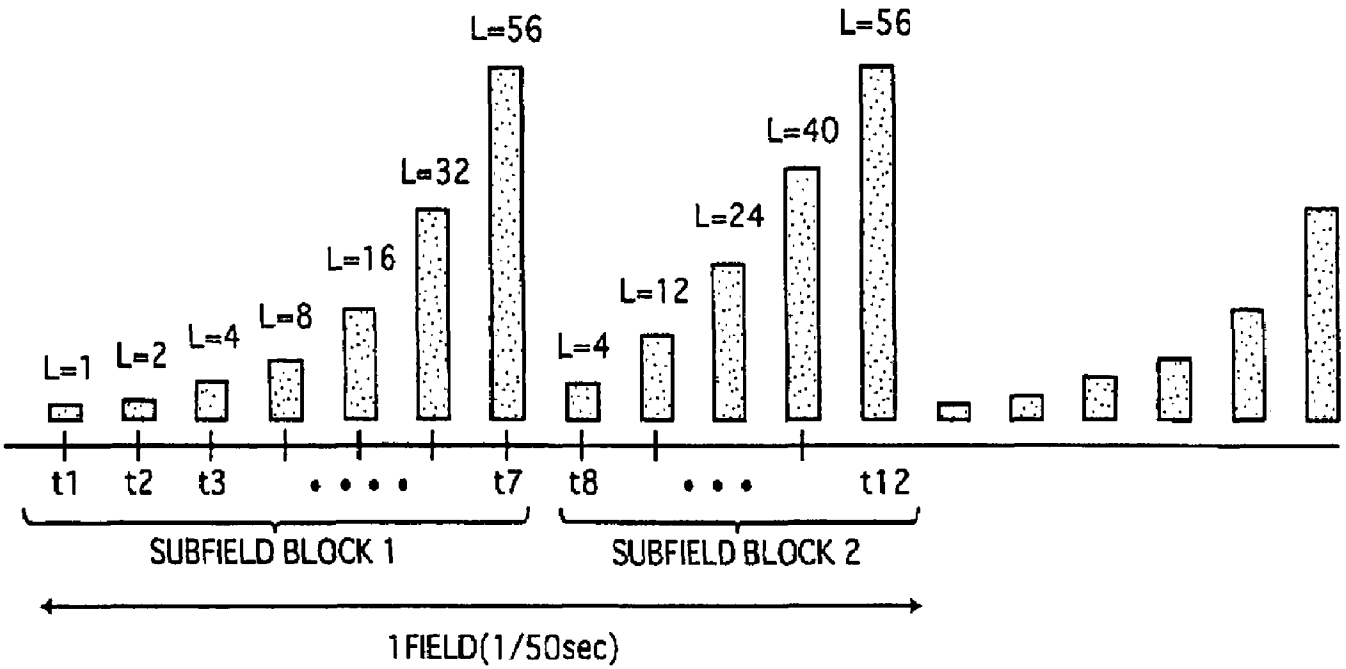
FIG. 14 is an outline for explaining a flicker component calculation method of a fourth embodiment of the present invention.

FIG. 14 is conceptual drawing for explaining an embodiment of the method in the present invention of calculating the flicker component. In FIG. 14 subfields that are controlled to be ON or OFF are approximated with illumination which has a predetermined amplitude value corresponding to the respective luminance weight. L=1 and so on are equivalent illumination amplitude values that show the amplitude values. For example, the third subfield has a time t3 in relation to the start of the field, and is approximated with an illumination that uses single pulse of an illumination intensity 4. Likewise, as another example, subfield number 7 has a time t7 and is approximated with an illumination that uses a single pulse of an illumination intensity 56. Furthermore, intervals t1, t2, etc between the pulses that are assumed to be single pulses are made to be uniform, with a sufficient non-illumination period between each of the subfields. Furthermore, the total number of the subfields is assumed to be twelve. If it is assumed that the non-illumination period between each subfield is sufficiently long, the time centers of illuminations in the subfields can be approximated with uniform time centers.

The following shows a method of calculating the field frequency component, in other words the flicker component, based on the illumination of the subfields approximated as described above. Since the field frequency component is the fundamental wave component of one cycle, the real component R of the field frequency component when all the subfields are ON is found from a discrete value Fourier transform as follows:

$$R=(1/12)(1+2*\mathrm{COS}(\pi/12)+4*\mathrm{COS}(2\pi/12)+\ldots+56*\mathrm{COS}(11\pi/12))$$

Likewise, the imaginary component J of the field frequency component is found as follows:

$$J=(1/12)(1+2*\mathrm{SIN}(\pi/12)+4*\mathrm{SIN}(2\pi/12)+\ldots 56*\mathrm{SIN}(11\pi/12)$$

Then, the absolute value of the field frequency component, in other words the flicker component, is expressed as described earlier as the square root of the squares of each of R and J.

Note that the above-described expression is for when all the subfields are illuminated. Generally to calculate it is necessary to replace the relevant items with zero according to the gray level and the encoding method therefor. In this way it is relatively easy to find the field frequency component, particularly when displaying gray scale by controlling ON/OFF for each subfield. In particular, is it very easy to determine an encoding method for controlling ON/OFF of illumination in subfields because it is very simple to calculate the field frequency component by approximating the plurality of pulses in a subfield with a single pulse.

Note that in the above explanation the illumination centers of the subfields are uniform, but the actual illumination time center of the subfields varies according to the luminance weight, the illumination pulse intervals, and so on. However, a substantially accurate value can be obtained according to the above-described method. Needless to say, it is however more desirable to execute the calculation using a more accurate illumination center position.

Figure 15:
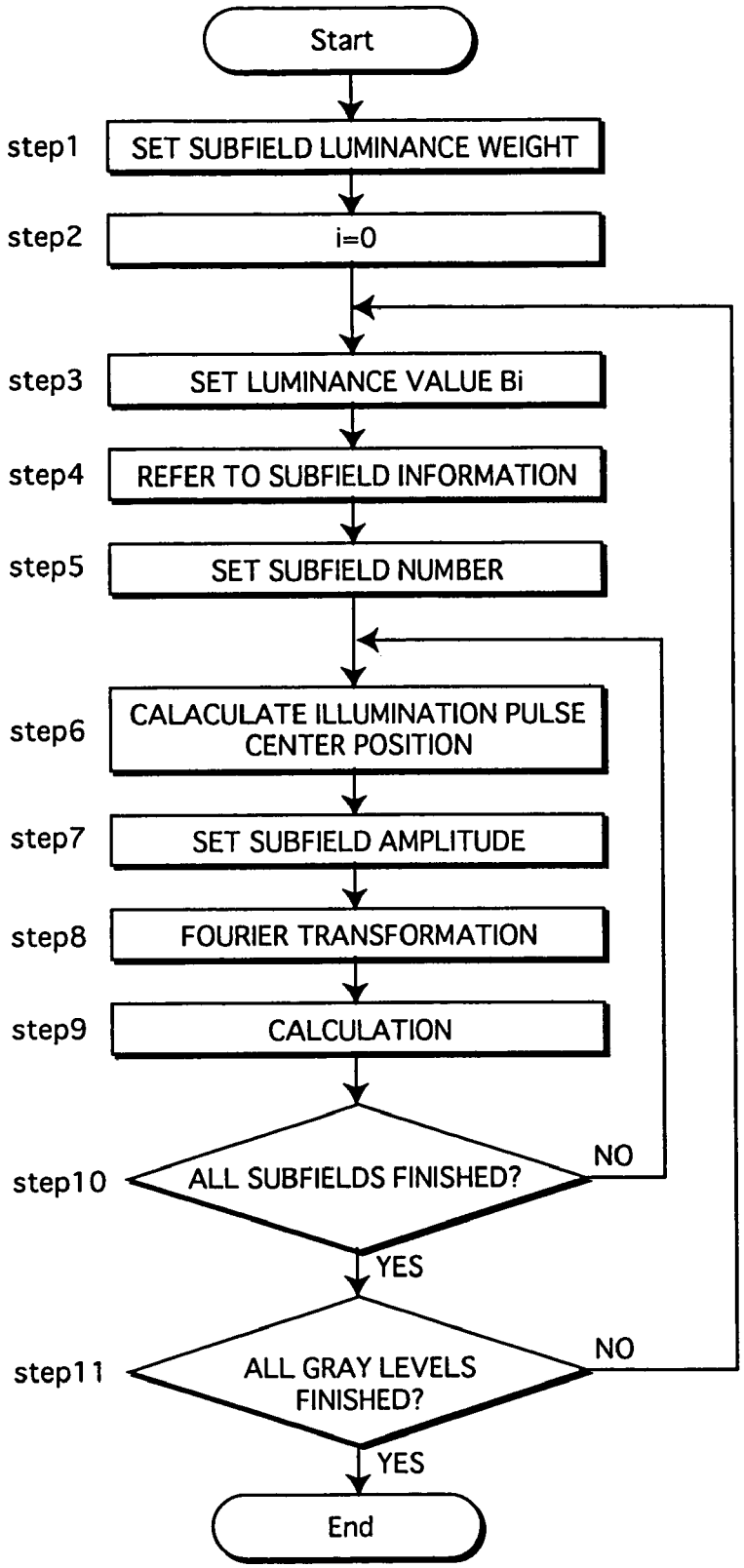
FIG. 15 is a flowchart showing one specific example of procedures in the above-mentioned method.

Next, specifically, the flicker component can be calculated according to a method such as that shown in FIG. 15. Note that the following processing is performed by a computer which includes memories such as a ROM and a RAM, and a CPU that performs computation procedures.

First, at step 1, after setting the luminance weight of each subfield, the gray level i to be displayed is set to "0" (step 2). An illumination value Bi to be displayed is set, in correspondence to this gray level i (step 3). Furthermore, ON/OFF information (subfield information) of each field that is pre-set for each gray level is referred to (step 4), to set the numbers of all the subfields that are ON (step 5). Next, the illumination center in the subfields is calculated as shown in FIGS. 14 (step 6), and at step 7 the amplitude is set for when illumination in each subfield is assumed to be according to a single pulse (L=56 . . . etc). Next, at step 8 the amplitude data is transformed according to Fourier transformation, the results are added at step 9. This processing is executed for all subfields that are ON and all gray levels (judgement at steps 10 and 11; if No at step 10, return to step 6; if No at step 11, return to step 3).

Thus, the flicker component in the luminance weight of the predetermined subfield can be calculated.

Note that such a method of calculating the flicker component can also be the steps of the method used by being made into a program, stored on a recording medium, and installed in a computer.

Furthermore, the above-described method can be executed not only by a general-purpose computer, but also by a purpose-built apparatus. In other words, the apparatus can be an independent flicker calculating apparatus having a function of executing the steps in the method in a chip.

Fifth Embodiment

The encoding method of the present embodiment in the subfield information generation unit differs from those of the previous embodiments in the following way.

In the previous embodiments subfield information is generated in correspondence with all the gray levels of an input signal, but here with a view to reducing the flicker component, images are displayed with specified gray levels so that the luminance value reduces the flicker component.

Figure 16:
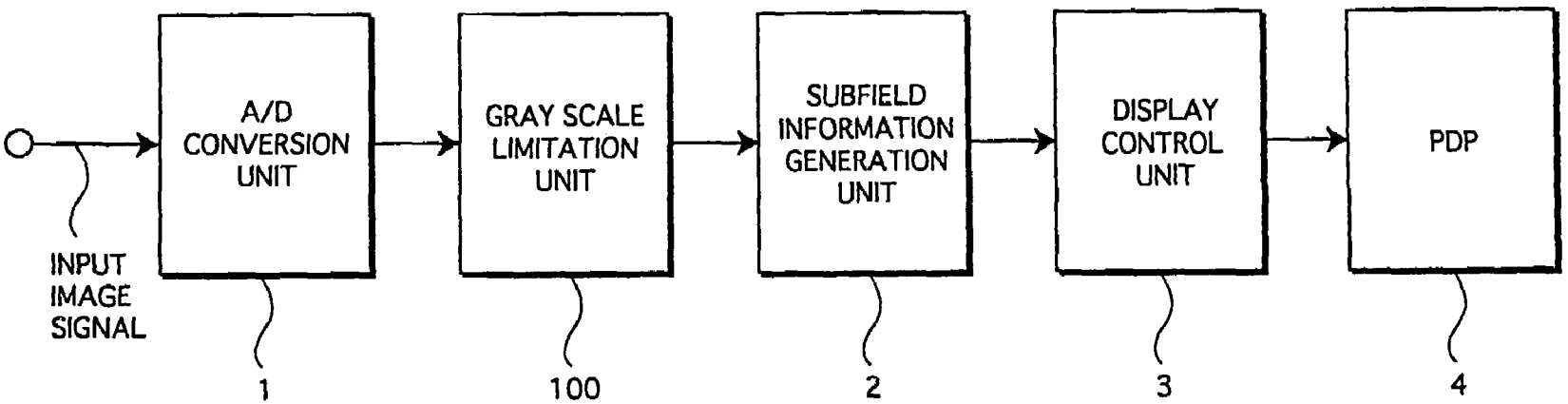
FIG. 16 is a block drawing showing the structure of a gray scale display apparatus in a fifth embodiment of the present invention.

FIG. 16 is a block drawing showing the structure of a gray scale display apparatus.

Specifically, as shown in FIG. 16, the gray scale display apparatus includes a gray scale limitation unit 100 in addition to the components shown in FIG. 1. This gray scale limitation unit 100 eliminates, according to a predetermined rule, input signals from amongst input digital signals of gray levels that contribute to increasing the flicker component. Then the gray scale limitation unit 100 limits the gray level to another gray level input signal that does not effect the flicker component greatly, and outputs this to the subfield information generation unit 2 downstream.

According to this, when the effect of a gray level on the flicker component is great, that gray level is not directly displayed. That gray level is converted by being substituted with another close gray level to be displayed that has a smaller flicker component.

Figure 17:
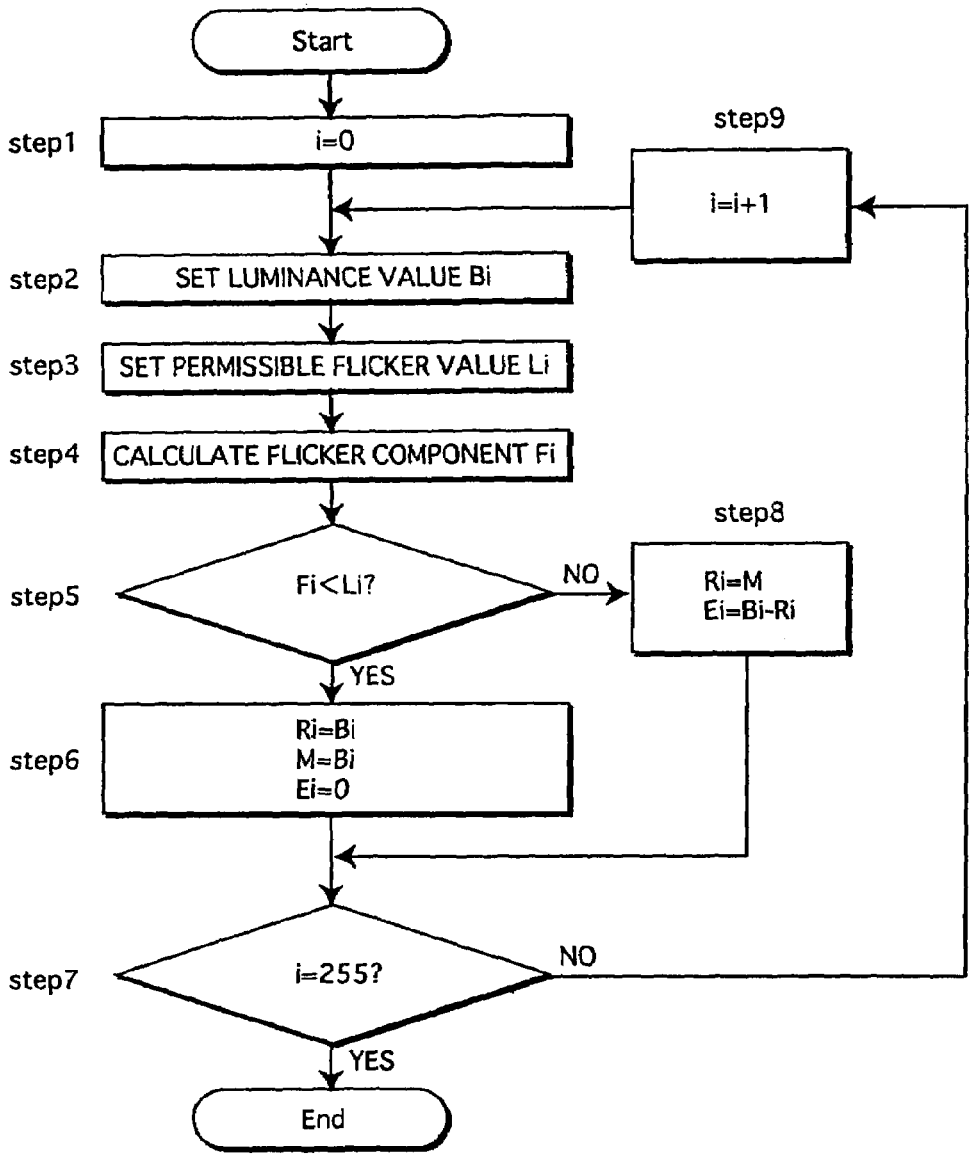
FIG. 17 is a flowchart showing an example of the gray scale limitation method in the above-mentioned structure.

This encoding is determined according to a procedure such as that in FIG. 17. The following explains the determining procedure following FIG. 17.

First, after setting the luminance weight of each subfield, the gray scale limitation unit 100 sets the value i of the gray level to be displayed to "0" (step 2). Furthermore, the gray scale limitation unit 100 sets a permissible flicker value Li for each luminance value (step 3). The gray scale limitation unit 100 may calculate, for each gray level i to be displayed, the flicker component Fi using parameters such as the luminance weight of each field (step 4). This calculation may be performed based on a method such as that explained in the first embodiment. Next, at step 5, the gray scale limitation unit 100 compares the sizes of the flicker component Fi and the permissible value Li, and if the flicker component is smaller than the permissible value (step 5, Yes), the gray scale limitation unit 100 writes to a conversion memory Ri. The gray scale limitation unit 100 simultaneously writes Ri to a temporary memory M for use in subsequent processing. Furthermore, at step 6, since the difference between the gray level to be displayed and the luminance value is zero, the gray scale limitation unit 100 writes "0" to an error value memory Ei.

On the other hand, at step 5 the if the flicker component is greater than the permissible flicker value (step 5, No), the processing proceeds to step 8 where not only the luminance value Bi is written to the conversion memory Ri, but also the value previously stored in the temporary memory M that generates a low amount of flickers is used as a substitute, and simultaneously the difference between the luminance value Bi and Ri is also written to the error value memory Ei.

The above-described processing is performed until the highest gray level to be displayed is reached (judged at step 7). If the highest level is not reached (step 7, No) the processing proceeds to step 9 where the display gray level is incremented, and then proceeds to step 2.

In this way, the gray level actually displayed, the gray level originally to be displayed, and the difference between these, are made into a conversion table in the gray scale limitation unit 100 for all the gray levels.

According to the above-described operations, a gray level that generates a large amount of flickers is not displayed, even in the luminance value that it was originally to be displayed in, but instead a close value with a low amount of flickers is used as a substitute. Furthermore, the difference between a luminance value in which the gray level was originally to be displayed and the actual luminance value displayed by a pixel unit is dispersed to surrounding pixels, therefore the average luminance value of the plurality of pixels including surrounding pixels is approximately equal to the luminance originally to be displayed. In this way, display can be performed without a great loss in display luminance, and with few flickers.

INDUSTRIAL USE

The present invention has a high industrial usage potential as it provides a gray scale display apparatus that controls illumination in binary, such as a plasma display panel, that generates few flickers.

The invention claimed is:

1. A gray scale display apparatus that displays gray scale according to combinations of illumination and non-illumination in each of the plurality of subfields, wherein the plurality of subfields is composed of at least a first block and a second block, the first block has more subfields than the second block, the blocks being different, and the respective subfields in both of the blocks being arranged in one of ascending order and descending order of luminance weight, at least two lowest subfields in ascending order of luminance weights of the plurality of subfields are selected substantially in order of luminance weight and arranged in succession at a head of the first block, and remaining subfields are distributed alternately between and arranged in ascending order of luminance weight in the first block and the second block, and subfields having high luminance weight are arranged alternately between the blocks.

2. A gray scale display apparatus of claim 1, wherein a highest luminance weight of the subfields included in each of the first block and the second block is substantially a same luminance weight.

3. A gray scale display apparatus of claim 1, wherein a ratio of the luminance weight of the subfield in each of the first block and the second block having the highest luminance weight is closer to one than a ratio of the subfields in the first block and the second block having the second highest luminance weights.

4. A gray scale display apparatus that displays gray scale according to combinations of illumination and non-illumination in each of the plurality of subfields, wherein the plurality of subfields is composed of at least a first block and a second block, the first block has more subfields than the second block, the blocks being different, and the respective subfields in both of the blocks being arranged in one of ascending order and descending order of luminance weight, at least two lowest subfields in ascending order of luminance weights of the plurality of subfields are selected in substantially order of luminance weight and arranged in succession at an end of the first block, and remaining subfields are distributed alternately between and arranged in descending order of luminance weight in the first block and the second block, and subfields having high luminance weight are arranged alternately between the blocks.

5. A gray scale display apparatus of claim 4, wherein a highest luminance weight of the subfields included in each of the first block and the second block is substantially a same luminance weight.

6. A gray scale display apparatus of claim 4, wherein a ratio of the luminance weight of the stibfield in each of the first block and the second block having the highest luminance weight is closer to one than a ratio of the subfields in the first block and the second block having the second highest luminance weights.

7. A gray scale display apparatus that displays gray scale according to illumination pulses in each of the plurality of subfields, the plurality of subfields are composed of at least a first block and a second block, the first block has more subfields than the second block, the blocks being different, and the respective subfields in both of the blocks being arranged in one of ascending order and descending order of luminance weight, at least two lowest subfields in ascending order of luminance weights of the plurality of subfields are selected substantially in order of luminance weight and arranged in succession at a head of the first block, and remaining subfields are distributed alternately between and arranged in ascending order of luminance weight in the first block and the second block, each of the illumination pulses in each of the plurality of subfields having a predetermined amplitude corresponding to the respective lace weight, and subfields having high luminance weight are arranged alternately between the blocks.

8. A gray scale display apparatus that displays gray scale according to illumination pulses in each of the plurality of subfields, the plurality of subfields are composed of at least a first block and a second block, the first block has more subfields than the second block, the blocks being different, and the respective subfields in both of the blocks being arranged in one of ascending order and descending order of luminance weight, at least two lowest subfields in ascending order of luminance weights of the plurality of subfields are selected substantially in order of luminance weight and arranged in succession at an end of the first block, and remaining subfields are distributed alternately between and arranged in ascending order of luminance weight in the first block and the second block, each of the illumination pulses in each of the plurality of subfields having a predetermined amplitude corresponding to the respective luminance weight, and subfields having high luminance weight are arranged alternately between the blocks.

* * * * *